US005456590A

United States Patent [19]

Volmari

[11] Patent Number: 5,456,590

[45] Date of Patent: Oct. 10, 1995

[54] COUNTER-ROTATING COMPACTION HEAD FOR MANUFACTURING CONCRETE PIPES

[75] Inventor: Wolfgang Volmari, Gernsbach, Germany

[73] Assignee: Ed. Züblin Aktiengesellschaft, Stuttgart, Germany

[21] Appl. No.: 108,928

[22] Filed: Aug. 17, 1993

[30] Foreign Application Priority Data

Aug. 17, 1992 [DE] Germany ..... 42 27 196.7
Jul. 8, 1993 [DE] Germany ..... 43 22 785.6

[51] Int. Cl.[6] ..... B28B 21/26

[52] U.S. Cl. ..... 425/262; 425/427; 264/312

[58] Field of Search ..... 425/262, 426, 425/427, 429, 456, 457, 460; 264/312

[56] References Cited

U.S. PATENT DOCUMENTS

| | | | |
|---|---|---|---|
| 3,096,556 | 7/1963 | Woods | 425/262 |
| 3,746,494 | 7/1973 | Gauger | 425/262 |
| 3,752,626 | 8/1973 | Trautner et al. | 425/262 |
| 4,540,539 | 9/1985 | Crawford et al. | 425/262 |
| 4,957,424 | 9/1990 | Mitchell et al. | 425/262 |
| 5,040,968 | 8/1991 | Kraiss | 425/262 |
| 5,080,571 | 1/1992 | Crawford | 425/262 |

FOREIGN PATENT DOCUMENTS

| | | |
|---|---|---|
| 2216648 | 10/1973 | Germany . |
| 2738944 | 3/1979 | Germany . |
| 3115181 | 11/1982 | Germany . |
| 3530953 | 3/1987 | Germany . |
| 4022089 | 1/1991 | Germany . |

*Primary Examiner*—James P. Mackey
*Attorney, Agent, or Firm*—Robert W. Becker & Associates

[57] ABSTRACT

A counter-rotating compaction head for manufacturing a concrete pipe is vertically positioned in a vertical mold within the longitudinal axis of the mold so as to be rotatable about and axially slidable along the longitudinal axis of the mold. The counter-rotating compaction head has a distributing head with distributing devices for distributing concrete and a cylindrical mantle. A first drive shaft rotates the distributing head. A smoothing piston with a smoothing mantle is rotatably driven by a second drive shaft counter to the distributing head. At least one vibrator for compacting and smoothing an inner wall surface of the concrete pipe to be manufactured is operatively connected to at least one of the cylindrical mantle of the distributing head and the smoothing mantle of the first smoothing piston so as to vibrate the respective mantle.

20 Claims, 5 Drawing Sheets

COUNTER-ROTATING COMPACTION HEAD FOR MANUFACTURING CONCRETE PIPES

BACKGROUND OF THE INVENTION

The present invention relates to a device for manufacturing especially reinforced concrete pipes within a vertical mold whereby within the longitudinal axis of the mold a counter-rotating compaction head is vertically positioned so as to be rotatable about and axially slidable along the longitudinal axis of the mold. The counter-rotating compaction head comprises a distributing head with distributing rollers which is rotatably driven by a first shaft and a smoothing piston with a smoothing mantle which is rotatably driven by a second shaft counter to the direction of rotation of the distributing head.

Known devices for manufacturing reinforced concrete pipes with counter-rotating compaction heads are known from German Patent 27 38 944 and German Patent 35 30 953. These known devices are comprised of a vertically extending pipe mold and one or more counter-rotating compaction heads rotating about a common longitudinal axis. These counter-rotating compaction heads have two different portions for performing varying functions. The upper portion is in the form of a plate which is driven by a shaft and has at its upper sides rotatably supported pressing rollers for pressing the supplied material into the outer pipe mold. A smoothing cylinder, also called smoothing head or smoothing piston, with or without a second set of pressing rollers determines as the second element the exact inner diameter of the pipe to be produced and determines the surface quality of the inner pipe wall.

In this context it is necessary for achieving an effective manufacture to rotate the counter-rotating compaction head at a very fast rotational speed and also move it in a very short period of time over the entire length of the pipe to be manufactured, i.e., move the compaction head axially to and fro.

With the known devices the outer and/or inner surface quality of the manufactured pipes does not always correspond to the required specifications. Furthermore, especially for pipes with reinforcement, there is the risk involved that the adhesion between the reinforcement and the concrete is flawed and that so-called reinforcement shadows result, for example, due to distortion or warping of the reinforcement during manufacture. In another known device a core that extends over the entire length of the tube predetermines the inner tube diameter. After completion of the manufacturing process of the pipe the entire core (see German Patent 22 16 648) or the entire casing including core (German Patent 31 15 181) is vibrated by a support plate.

These known devices have the disadvantage that excessive vibration of the concrete may occur such that within the pipe so-called vibration nests are formed and separation of the concrete takes place. In order to prevent such excessive vibration, it is known (German Patent 40 22 089) not to centrally vibrate the core, but to partially vibrate the core with different vibrators. Such a method however requires a complex and complicated apparative design; furthermore, the construction of the core with a plurality of vibrators is very complicated.

It is therefore an object of the present invention to provide a device with which the disadvantages of the known devices can be overcome, which has a simple construction and with which especially reinforced concrete pipes can be manufactured in an economic manner with uniform, flawless compaction. The inventive device should furthermore be of a comparatively simple construction.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
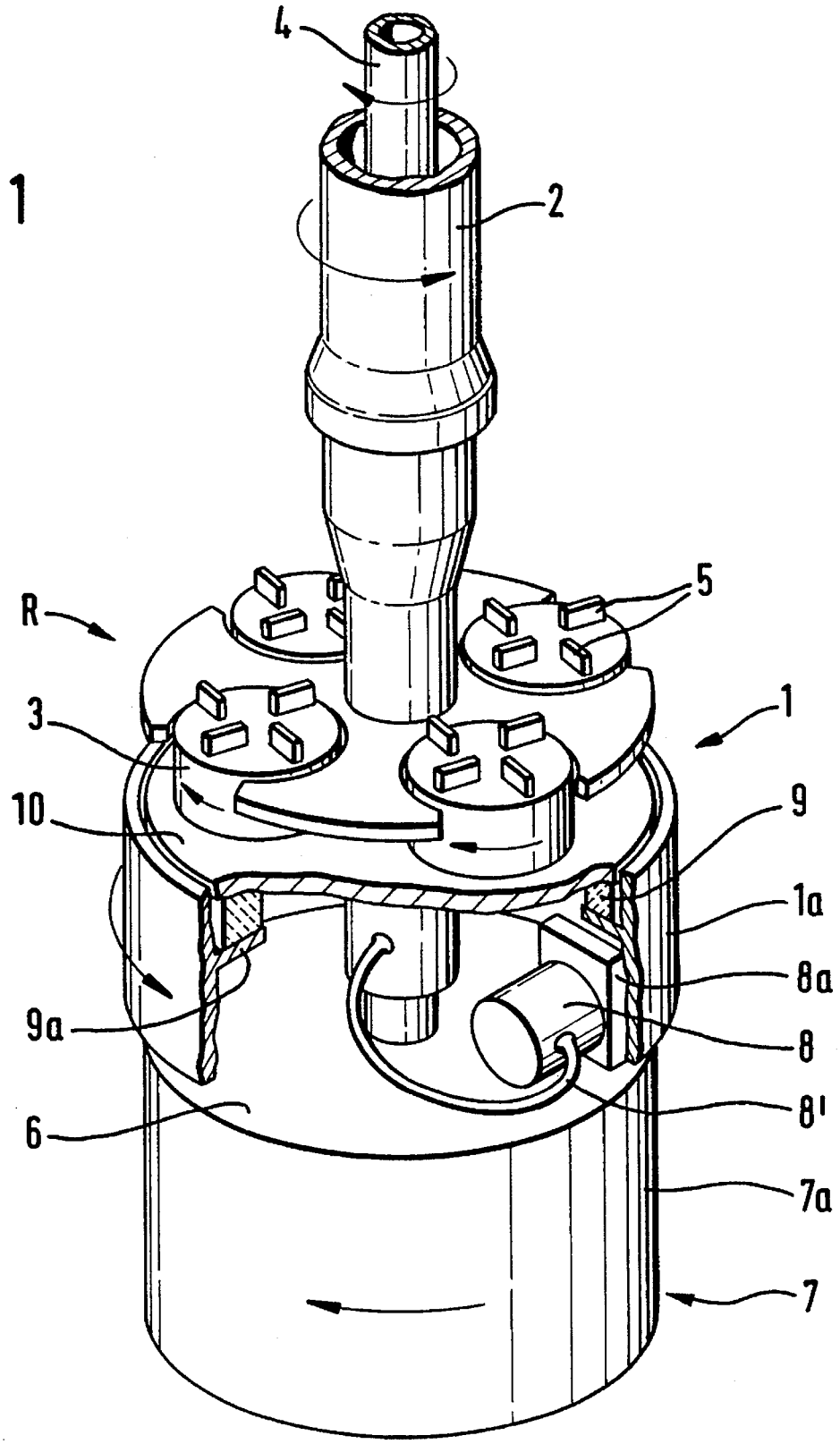
FIG. 1 shows a first embodiment of the inventive counter-rotating compaction head with the vibrator acting on the cylindrical mantle of the distributing head.

The counter rotating compaction head of the present invention is primarily characterized by:

A distributing head having distributing means for distributing concrete and a cylindrical mantle;

A first drive shaft for rotating the distributing head;

A first smoothing piston with a smoothing mantle;

A second drive shaft for rotating the first smoothing piston counter to the distributing head; and At least one vibrator for compacting and smoothing an inner wall surface of a concrete pipe, the vibrator connected to at least one of the cylindrical mantle of the distributing head and the smoothing mantle of the first smoothing piston so as to vibrate at least one of the cylindrical mantle of the distributing head and the smoothing mantle of the first smoothing piston.

In a preferred embodiment of the present invention, the vibrator is connected within the distributing head and vibrates the cylindrical mantle of the distributing head. In the alternative, the vibrator is connected within the first smoothing piston and vibrates the smoothing mantle of the first smoothing piston.

Preferably, the vibrator comprises a support plate, the support plate connected to the cylindrical mantle of the distributing head or to the smoothing mantle of the first smoothing piston. Expediently, the vibrator produces vibrations having a radial orientation relative to the first or second drive shaft.

Advantageously, the vibrator comprises a vibration damping mount for mounting the vibrator to the distributing head or to the first smoothing piston. Preferably, the distributing head comprises a base plate and the cylindrical mantle comprises an inner wall surface with an abutment for receiving the vibration damping mount, wherein the base plate rests on the vibration damping mount. In the alternative, the first smoothing piston comprises a piston base plate and the smoothing mantle comprises an inner wall surface with an abutment for receiving the vibration damping mount, wherein the piston base plate rests on the vibration damping mount.

In a preferred embodiment of the present invention, the counter-rotating compaction head further comprises auxiliary rollers connected between the distributing head and the first smoothing piston, wherein the distributing means are distributing rollers and the auxiliary rollers rotate counter to the distributing rollers.

In another preferred embodiment of the present invention, the distributing head is conically shaped at least in an upper portion thereof and said distributing means are in the form of distributing paddles connected to the upper portion.

Preferably, a ratio of an axial length of the distributing head to an axial length of the first smoothing piston is between 1:1 to 1:3.

Preferably, the inventive counter-rotating compaction head further comprises a second smoothing piston connected below the first smoothing piston. Preferably, a ratio of the axial length of the distributing head to the axial length of the first smoothing piston to the axial length of the second smoothing piston is between 1:1:1 to 1:3:3.

In a preferred embodiment of the present invention, the distributing means are distributing rollers.

With the present invention it is possible to employ in a constructively simple manner vibration generators, i.e., vibrators, either within the distributing head or within the smoothing piston of the counter-rotating compaction head, respectively, when needed, within the distributing head as well as within the smoothing piston, especially in adaptation to the dimensions of the pipes to be manufactured. The mounting of one or more vibrators is relatively simple, especially when they are mounted on a support plate which is directly connected to the part of the counter-rotating compaction head that is to be vibrated. The vibrator therefore can be mounted within the distributing head or within the smoothing piston or within both such that its vibrations act along the shortest possible path either on the cylindrical mantle of the distributing head or the smoothing mantle of the smoothing piston. It is advantageous that in further embodiments of the invention between the vibration-generating elements, i.e., the vibrator or vibrators, and the non-vibrating components of the counter-rotating compaction head vibration damping elements, for example, vibration damping mounts or vibration mounts, are provided. Such vibration mounts are comprised of rubber elements that are fixedly connected to metal parts, for example, by vulcanization. These vibration mounts must be selected in their stiffness corresponding to the respective constructive and operational conditions.

DESCRIPTION OF PREFERRED EMBODIMENTS

The present invention will now be described in detail with the aid of several specific embodiments utilizing FIGS. 1 through 5. FIG. 1 shows a counter-rotating compaction head R with a base plate 10 on which a plurality of distributing means in the form of distributing rollers 3 is supported. On the upper side of the distributing rollers 3 paddles 5 are provided which distribute the material for manufacturing the pipes, especially concrete, outwardly to the pipe mold, not represented in the drawings, that surrounds the compaction head R. The distributing rollers 3 also have the function of distributing the concrete material. The distributing head 1 is driven by a drive shaft 2. The distributing rollers 3 are rotated by frictional contact with the concrete material in a direction counter to the direction of rotation of the drive shaft 2. The distributing head 1 is provided with a cylindrical mantle 1*a* which rotates in the direction of rotation of the drive shaft 2 and compacts the concrete material. Below the distributing head 1 with cylindrical mantle 1*a* a smoothing piston 7 is provided which is driven by a separate drive shaft 4 counter to the direction of rotation of the distributing head 1. The smoothing piston 7 has a smoothing mantle 7*a* for smoothing the inner surface of the pipe to be manufactured and for exactly determining the inner diameter of the smoothed tube.

According to the present invention, the counter-rotating compaction head R is provided with a vibrator 8 which, in the embodiment according to FIGS. 1 through 5, is in operative connection with the cylindrical mantle 1*a* or smoothing mantle 7*a* such that its vibrations are transmitted on a relatively short path onto the cylindrical mantle 1*a* respectively 7*a*. In the embodiments according to FIGS. 1 to 4 the vibrator 8 acts on the cylindrical mantle 1*a* of the distributing head 1. In the embodiment according to FIG. 5 the vibrator 8 acts on the smoothing mantle 7*a* of the smoothing piston 7. It is also possible to envision an embodiment in which the distributing head 1 and the smoothing piston 7 each have a vibrator 8.

Figure 2:
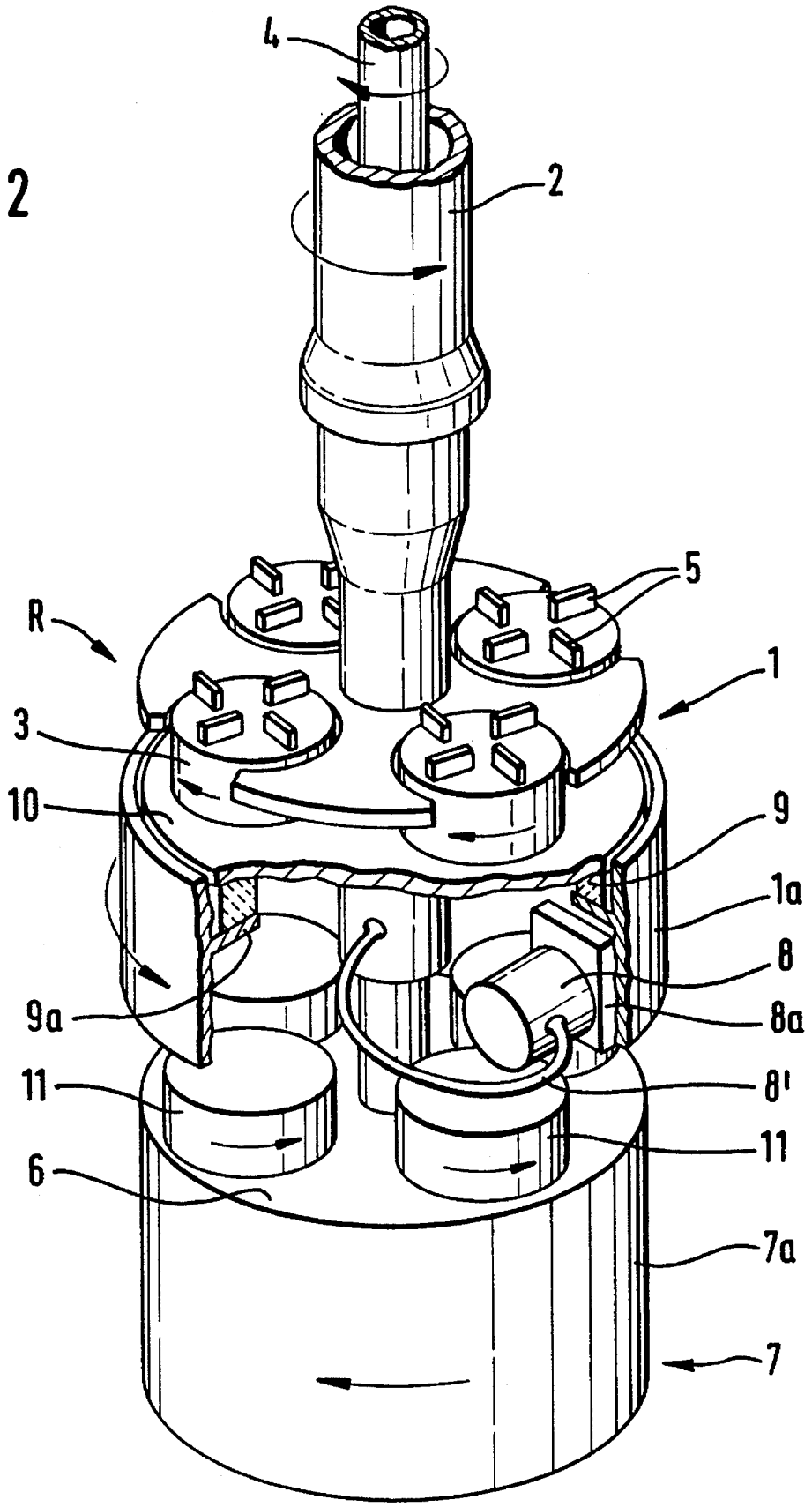
FIG. 2 shows a further embodiment of the present invention in which a set of auxiliary rollers is positioned between the distributing head and the smoothing piston.
Figure 3:
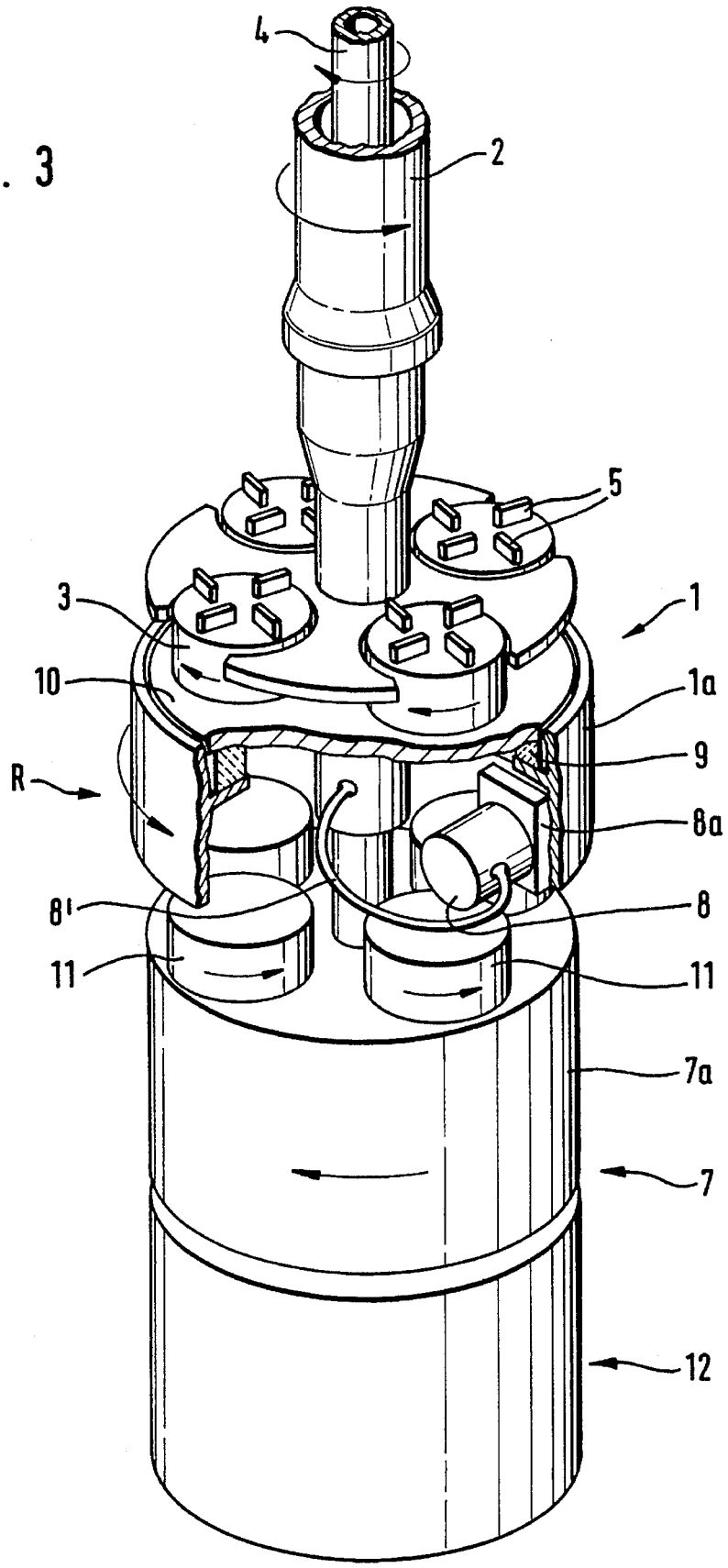
FIG. 3 shows another embodiment of the inventive counter-rotating compaction head having a second smoothing piston arranged below the first smoothing piston.
Figure 4:
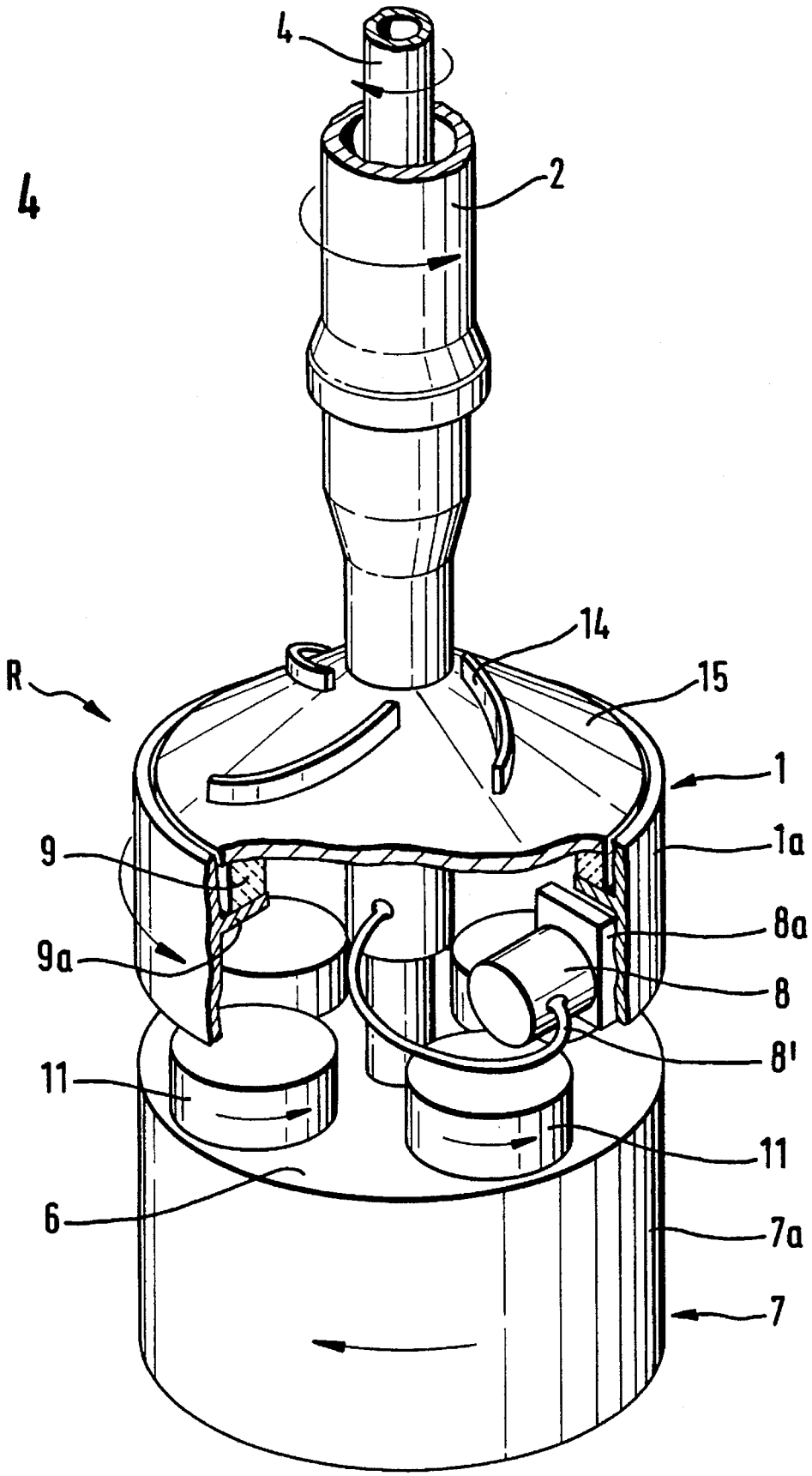
FIG. 4 shows another preferred embodiment of the present invention in which the distributing head has an upper, conically shaped portion with distributing paddles.

In the embodiment according to FIG. 1 and the embodiments of FIGS. 2, 3, and 4, the vibrator 8 is connected within the distributor head 1 and is in vibrational connection with the cylindrical mantle 1*a* so as to vibrate the mantle 1*a*. In all of the aforementioned embodiments the vibrator 8 is supported on a support plate 8*a* which is connected to the respective distributor head 1, preferably to its cylindrical mantle 1*a*, for example, by welding or similar means. The orientation of the vibrations generated by the vibrator 8 is radial to the drive shaft 2 of the distributor head 1. In order to prevent that vibrations of the vibrator 8 are transmitted to other components of the counter-rotating compaction head R, which should not be exposed to such vibrations, vibration damping mounts 9 are provided which are arranged such that the transmission to components which should not be exposed to vibrations is prevented. The vibration damping mounts 9 furthermore allow the cylindrical mantle 1*a* or the smoothing mantle 7*a* to vibrate freely.

In the embodiments according to FIGS. 1 to 4, a vibration damping mount 9, preferably a vibration dampening connector or resilient cushioning, is provided between the vibrator 8 and the cylindrical mantle 1*a* to be vibrated and the components of the compaction head R not to be vibrated, especially the base plate 10. The vibration dampening mount 9 is supported on an abutment 9*a* which is provided at the inner wall surface of the distributing head 1 as a horizontally extending annular flange. The base plate 10 of the distributing head 1 rests on the upper surface of the thus supported vibration damping mount 9, as is schematically represented in FIGS. 1 to 4.

The vibration damping mount 9, depending on the selected materials of the base plate 10, may be stiff or flexible in order to achieve the desired damping effect. In the shown embodiments the vibration damping mount 9 is in the form of an annular element, respectively, annular segments which are arranged over the entire circumference of the abutment 9*a*. It is also possible to employ spring elements etc. as the vibration damping mount 9. A device is provided with which the frequency and amplitude of the radially oriented vibrations of the vibrator can be adjusted continuously.

In the embodiment according to FIG. 2 the same basic construction as described in FIG. 1 is shown. Same parts are referenced with same reference numerals. The embodiment according to FIG. 2 differs from the embodiment of FIG. 1 in that the compaction head R is provided with auxiliary rollers 11 which are connected between the distributing head 1 and the smoothing piston 7. The auxiliary rollers 11 rotate with the distributing head 1, i.e., counter to the distributing rollers 3.

In FIG. 3 a further embodiment based on FIG. 2 is shown in which a second smoothing piston 12 is provided in addition to the first smoothing piston 7 such that the second smoothing piston 12 is connected below the smoothing piston 7. This second smoothing piston 12 is rotatably supported relative to the smoothing piston 7 and does not rotate during the manufacture of a concrete pipe, i.e., is thus at least approximately stationary because it is braked by the friction between the concrete and its surface area. The second smoothing piston 12 may also be provided with its own drive, which is not shown in the drawings. This drive may be in the form of a separate third drive shaft or may be provided as a gear box, preferably, a planet gear system, provided within the smoothing piston 12. The direction of rotation of the additional driven smoothing piston 12 may be identical to or counter to the direction of rotation of the first smoothing piston 7. The number of revolutions of the second smoothing piston 12 can be identical to or different from the number of revolutions of the smoothing piston 7 and is continuously adjustable.

In a further embodiment shown in FIG. 4, the distributing head 1 in its upper portion 15 is conically shaped and instead of being provided with the distributing rollers 3 has a plurality of distributing paddles 14. The concrete material which from the center of the distributing head 1 glides downwardly and outwardly along the slope of the conical portion 15 is additionally outwardly accelerated due to the rotation of the distributing head 1 whereby this acceleration effect is entranced by the distributing paddles 14. The shape of the distributing paddles 14 can be straight or, depending on the respective operational conditions, curved such that a substantially optimal gliding paddle for the descending concrete material is formed.

It is expedient to provide a ratio of axial lengths between the distributing head 1 and the smoothing piston 7 such that this ratio is between 1:1 and 1:3, as shown in FIGS. 1, 2, and 4. In the embodiment according to FIG. 3 the ratio of the axial lengths of the distributor head 1 to the first smoothing piston 7 and the second smoothing piston 12 is between 1:1:1 and 1:3:3. Of course, other dimensions are also possible especially in view of the fact that this ratio is determined by the constructive details and the design of the pipe to be manufactured.

Figure 5:
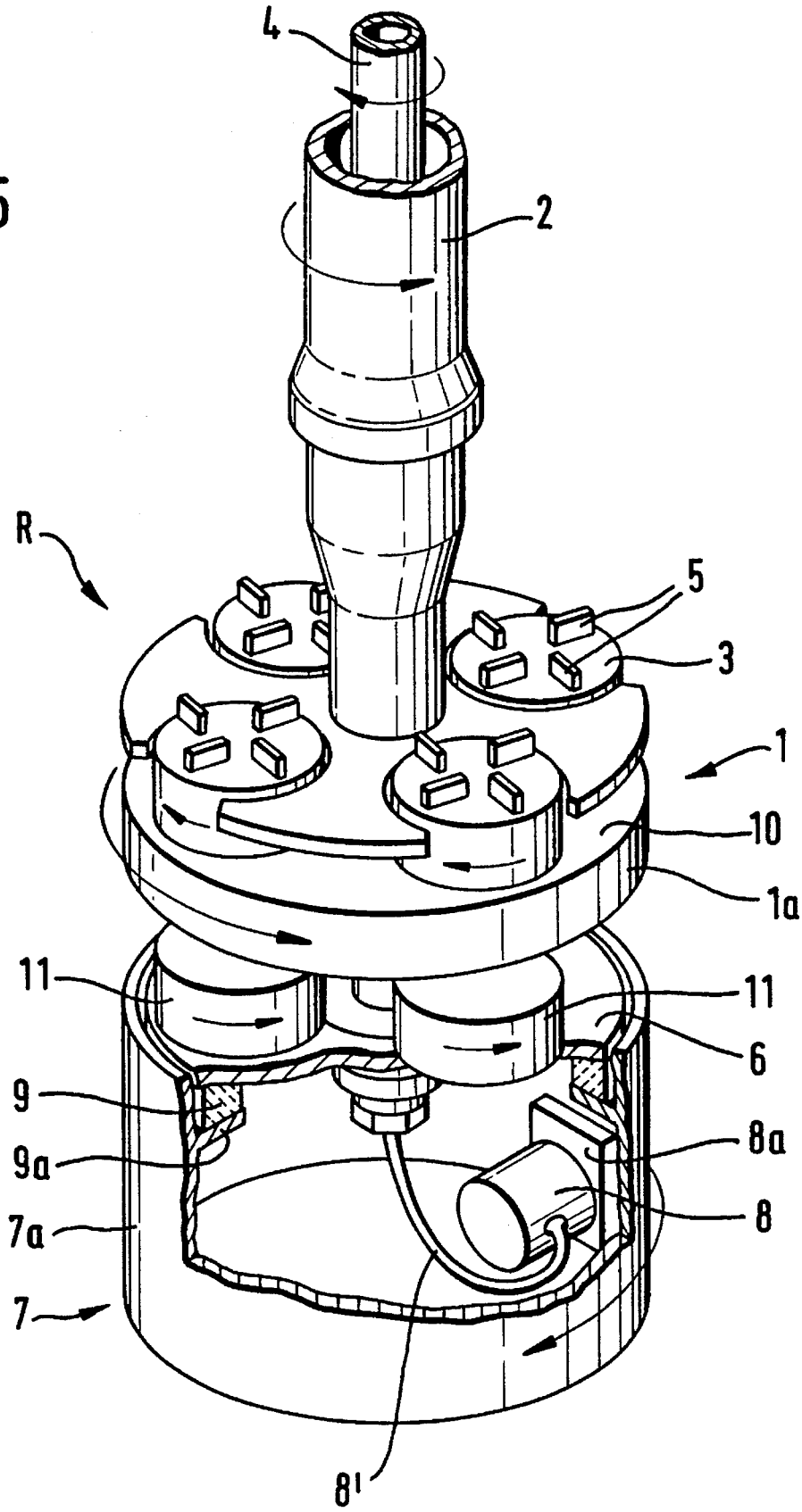
FIG. 5 shows an embodiment of the present invention in which the vibrator acts on the smoothing mantle of the smoothing piston.

In the embodiment according to FIG. 5, the basic construction of the compaction head R corresponds to the one disclosed in FIGS. 1 to 4, especially with respect to the drive shaft 2 and 4, the distributing head 1, and the smoothing piston 7 arranged below the distributing head 1. The difference is that the vibrator 8 is not arranged within the distributing head 1, but within the smoothing piston 7 and accordingly is in a vibrational connection with the smoothing mantle 7*a*. In this embodiment, only the smoothing mantle 7*a* of the smoothing piston 7 is vibrated by the vibrator 8. The arrangement of the vibration damping mount 9 corresponds to the one disclosed in FIGS. 1 to 4: At the inner wall surface of the smoothing mantle 7*a* a flange-type abutment 9*a* for the vibration damping mount 9 is provided on which the piston base plate 6 covering the smoothing piston 7 is resting. As described supra, the vibrator 8 is supported at a stationary support plate 8 which is connected to the smoothing mantle 7*a*, for example, by welding. Between distributing head 1 and smoothing piston 7 auxiliary rollers 11 are provided which rotate counter to the direction of rotation of the distributing rollers 3.

The vibrator or vibrators 8 in all embodiments may be driven hydraulically, for example, by oil, or pneumatically, for example, with compressed air, or electrically. The drive media for these drives can be supplied via conduits, not represented in the drawings, preferably through the inner drive shaft 4 or via an outer drive shaft, for example, the drive shaft 2, to the vibrator 8. A portion of such a conduit is shown in the drawings and referenced with reference numeral 8'. At the respective penetration locations of these conduits, known rotational connectors can be provided in which one part rotates while the other part is stationary so that a liquid or gaseous drive medium can be reliably supplied via the rotating drive shaft to the vibrator.

The present invention is, of course, in no way restricted to the specific disclosure of the specification and drawings, but also encompasses any modifications within the scope of the appended claims.

What I claim is:

1. A counter-rotating compaction head for manufacturing a concrete pipe in a vertically positioned mold, said counter-rotating compaction head vertically positioned within a longitudinal axis of the mold so as to be rotatable about and axially slidable along the longitudinal axis of the mold, said counter-rotating compaction head comprising:

a distributing head having distributing means for distributing concrete and a cylindrical mantle;

a first drive shaft for rotating said distributing head;

a first smoothing piston with a smoothing mantle;

a second drive shaft for rotating said first smoothing piston counter to said distributing head;

at least one vibrator for compacting and smoothing an inner wall surface of a concrete pipe, said vibrator operatively connected to at least one of said cylindrical mantle of said distributing head and said smoothing mantle of said first smoothing piston so as to vibrate at least one of said cylindrical mantle of said distributing head and said smoothing mantle of said first smoothing piston;

a vibration damping mount for protecting said distributing means from vibrations; and wherein said distributing head comprises a base plate having connected thereto said distributing means and said cylindrical mantle comprises an inner wall surface with an abutment for receiving said vibration damping mount, wherein said base plate rests on said vibration damping mount.

2. A counter-rotating compaction head according to claim 1, wherein said vibrator is connected within said distributing head and vibrates said cylindrical mantle of said distributing head.

3. A counter-rotating compaction head according to claim 1, wherein said vibrator comprises a support plate, said support plate connected to said cylindrical mantle of said distributing head.

4. A counter-rotating compaction head according to claim 1, wherein said vibrator produces vibrations having a radial orientation relative to said first drive shaft.

5. A counter-rotating compaction head according to claim 1, further comprising auxiliary rollers connected between said distributing head and said first smoothing piston, wherein said distributing means are distributing rollers and said auxiliary rollers rotate counter to said distributing rollers.

6. A counter-rotating compaction head according to claim 1, wherein said distributing head is conically shaped at least in an upper portion thereof and said distributing means are in the form of distributing paddles connected to said upper portion.

7. A counter-rotating compaction head according to claim 1, wherein a ratio of an axial length of said distributing head to an axial length of said first smoothing piston is between 1:1 to 1:3.

8. A counter-rotating compaction head according to claim 1, further comprising a second smoothing piston, connected below said first smoothing piston.

9. A counter-rotating compaction head according to claim 8, wherein a ratio of an axial length of said distributing head to an axial length of said first smoothing piston to an axial length of said second smoothing piston is between 1:1:1 to 1:3:3.

10. A counter-rotating compaction head according to claim 1, wherein said distributing means are distributing rollers.

11. A counter-rotating compaction head for manufacturing a concrete pipe in a vertically positioned mold, said counter-rotating compaction head vertically positioned within a longitudinal axis of the mold so as to be rotatable about and axially slidable along the longitudinal axis of the mold, said counter-rotating compaction head comprising:

a distributing head having distributing means for distributing concrete and a cylindrical mantle;

a first drive shaft for rotating said distributing head;

a first smoothing piston with a smoothing mantle;

a second drive shaft for rotating said first smoothing piston counter to said distributing head;

at least one vibrator for compacting and smoothing an inner wall surface of a concrete pipe, said vibrator operatively connected to at least one of said cylindrical mantle of said distributing head and said smoothing mantle of said first smoothing piston so as to vibrate at least one of said cylindrical mantle of said distributing head and said smoothing mantle of said first smoothing piston;

a vibration damping mount for protecting said distributing head from vibrations; and wherein said first smoothing piston comprises a piston base plate on which said distributing head is mounted and said smoothing mantle comprises an inner wall surface with an abutment for receiving said vibration damping mount, wherein said piston base plate rests on said vibration damping mount.

12. A counter-rotating compaction head according to claim 11, wherein said vibrator is connected within said first smoothing piston and vibrates said smoothing mantle of said first smoothing piston.

13. A counter-rotating compaction head according to claim 11, wherein said vibrator comprises a support plate, said support plate connected to said smoothing mantle of said first smoothing piston.

14. A counter-rotating compaction head according to claim 11, wherein said vibrator produces vibrations having a radial orientation relative to said first drive shaft.

15. A counter-rotating compaction head according to claim 11, further comprising auxiliary rollers connected between said distributing head and said first smoothing piston, wherein said distributing means are distributing rollers and said auxiliary rollers rotate counter to said distributing rollers.

16. A counter-rotating compaction head according to claim 11, wherein said distributing head is conically shaped at least in an upper portion thereof and said distributing means are in the form of distributing paddles connected to said upper portion.

17. A counter-rotating compaction head according to claim 11, wherein a ratio of an axial length of said distributing head to an axial length of said first smoothing piston is between 1:1 to 1:3.

18. A counter-rotating compaction head according to claim 11, further comprising a second smoothing piston, connected below said first smoothing piston.

19. A counter-rotating compaction head according to claim 18, wherein a ratio of an axial length of said distributing head to an axial length of said first smoothing piston to an axial length of said second smoothing piston is between 1:1:1 to 1:3:3.

20. A counter-rotating compaction head according to claim 11, wherein said distributing means are distributing rollers.

* * * * *